United States Patent [19]

Livio et al.

[11] 3,985,067

[45] Oct. 12, 1976

[54] LABELLING MACHINE FOR GARMENTS

[76] Inventors: Liberatori Livio, Via Bernardino da Siena; Berneschi Ciro; Liberatori Lorenzo, both of Via S. Bernardino da Siena 12, all of, Arezzo, Italy

[22] Filed: Jan. 3, 1975

[21] Appl. No.: 538,499

[30] Foreign Application Priority Data

Jan. 9, 1974 Italy ..... 1201/74
Dec. 11, 1974 Italy ..... 30403/74

[52] U.S. Cl. ..... 93/88; 93/87
[51] Int. Cl.[2] ..... B31F 7/00
[58] Field of Search ..... 93/87, 88, 89, 92; 227/25, 65, 67

[56] References Cited

UNITED STATES PATENTS

| | | | |
|---|---|---|---|
| 2,659,520 | 11/1953 | Reitzes | 93/87 |
| 2,754,751 | 7/1956 | Marsh et al. | 93/87 X |
| 3,095,787 | 7/1963 | Cornwell et al. | 93/88 |
| 3,545,389 | 12/1970 | Stephens et al. | 93/87 X |
| 3,598,025 | 8/1971 | Cotton | 93/87 |

*Primary Examiner*—James F. Coan

[57] ABSTRACT

A machine for applying labels to garments in which labels are automatically withdrawn from a source of supply, fed to a fixing station, printed with garment identifying indicia and thence attached to a garment with a plastic retainer which is applied by a selectively controllable device carried by the machine in operative association with the fixing station.

3 Claims, 6 Drawing Figures

LABELLING MACHINE FOR GARMENTS

BACKGROUND OF THE INVENTION

This invention relates to a labelling machine for garments. In the garment fabricating line a station is provided for fixing a label or tag to a garment which has been previously printed with identifying indicia such as the garment size, color, model or other necessary particulars.

Labelling occurs by manually locating a label, fixing it to the garment in a selected position by a retainer of plastic material which is driven through the cloth and the label by an appropriate tool, by seaming with a conventional sewing machine or other suitable attaching means such as clamping.

Garment labelling creates what is considered excessive time loss and an object of this invention is to reduce this time by the automatic printing and feeding of labels to the fixing device.

The technical problem to be solved is to provide a labelling machine of the above type in which labels are automatically drawn from a container, and thence advanced to the fixing station where they are printed and ready for attachment to a garment, which an operator manually positions at said fixing station.

The labelling machine, for solution of the technical problem, must be capable of automatically positioning the next label to be attached in the fixing station, after the previous one has been fixed on a garment.

SUMMARY OF THE INVENTION

The technical problem solved by the labelling machine which is an object of this invention includes a holder or container for the labels, a fixing station for locating the labels for attachment to garments, transport means for withdrawing the labels from the holder and separately advancing them to the fixing station; an electrically controlled drive means with a first switch means to actuate the transport means; and a second switch means to cause a cessation of the actuation of the transport means.

Another characteristic of the invention is a printing device disposed intermediate the label holder and the fixing station which automatically prints the data of the garment on each label prior to its attachment to the garment.

DESCRIPTION OF THE INVENTION

Figure 1:
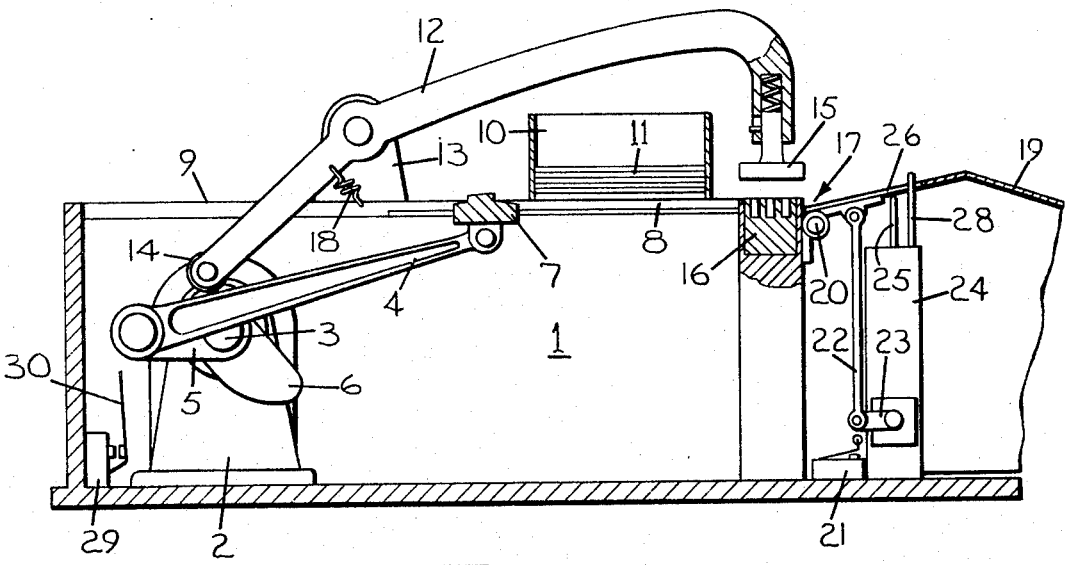
FIG. 1 is a front view in partial section showing one form of fixing station for the labelling machine according to the invention.

With reference to FIG. 1 the labelling machine includes a frame 1 within which an electric drive motor 2 is mounted. The motor's driving shaft is identified by numeral 3 and supports for actuation thereby a pair of interconnected crank arms 4 and 5 and a cam member 6.

One end of crank arm 4 has a sliding shoe 7 pivotally attached thereto which is slidable within guides 8 formed in the top plate 9 of the frame 1. This top plate 9 also supports a container 10 within which labels 11 are carried and individually withdrawn for attachment to a garment.

A double armed lever 12 is pivotally carried by a pair of spaced supports 13 and one end of this lever 12 is provided with a roller 14 that is located so as to maintain contact with the outer periphery of cam 6.

The opposite end of lever 12 carries a buffer element 15 for pressing a label 11 against a block 16 for printing identifying indicia on said label 11 which was positioned therebetween by the sliding shoe 7.

The roller 14 is maintained in contact with the outer periphery of cam 6 by means of a coil spring 18.

The fixing station 17 includes a swing plate 19 that is pivotally supported by a hinge 20 and defines a supporting plane for the garment to be labelled as well as a means for actuation of a switch 21 which controls actuation of the means yet to be described for attaching a label to a garment.

Actuation of the switch 21 (FIG. 1) is controlled by a rod 22 one end of which is pivotally connected to the swing plate 19 and the opposite end to a triggering element 23 of a known form of driving piston 24. This driving piston 24 is provided at its upper end with a known type of grooved needle 25 the free end of which is disposed in close proximity with an opening 26 in the swing plate 19 and is caused to protrude through said opening and the garment to be labelled each time the swing plate is pressed downwardly. With each downward movement of the swing plate 19, the grooved needle 25 is effective in threading a plastic retainer 27, of the type shown in FIG. 6, through a garment and a hole in a label which attaches the latter to the garment.

As shown in FIG. 1 the fixing station 17 includes a rod 28 extending upwardly through opening 26 and serves as a stop for positioning a label to be attached to a garment.

Figure 2:
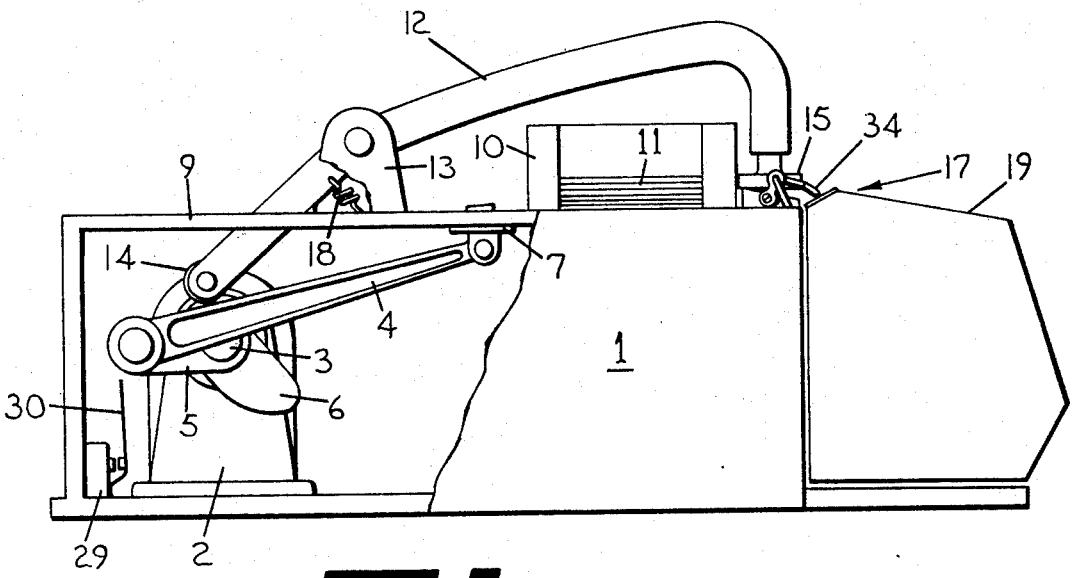
FIG. 2 is a front view of the labelling machine according to the invention showing a modification of the fixing station.

As shown in FIGS. 1 and 2 a second switch means 29 is fixed in the frame 1 adjacent the motor 2 and is disposed so that its actuator 30 will be engaged by and actuated by the end of the crank arm 4 each time the latter is in the position represented by FIG. 1. In this position the sliding shoe 7 is located rearwardly of the container 10 which is the end of the label feed cycle and whereat switch 29 is actuated to prevent further label feeding until the previous label is removed from the fixing station 17 with the garment to which it was attached.

Operation of the labelling machine is as follows:

After filling the container 10 with labels 11 and with the holes 52 provided in said labels being oriented toward the fixing station 17, the electric motor 2 is started by pressing the swing plate 10 downwardly.

The starting of the electric motor 2 actuates the crank arms 4 and 5 causing the sliding shoe 7 to move toward the right as shown in FIGS. 1 and 2 and is effective in advancing the lowermost label 11 in container 10 to the fixing station 17 and against the rod 28 whereat its hole 52 is located in alignment with the grooved needle 25.

During the return stroke of sliding shoe 7 the cam 6 causes an oscillation of the lever 12 which effects the printing of the identifying indicia carried on the block 16 onto the label 11.

The motor 2 continues its rotation till the end of the crank arm 4 engages the actuator 30 of the switch 29 which then shuts off the motor to stop rotation thereof.

After this first phase of preparation the labelling machine is ready to attach a label to a garment. The operator has only to put the garment to be labelled onto the swing plate 19 in an appropriate position and to push said plate downwardly to effect automatically both the threadening of a plastic retainer 27 through the garment and the label, and the feeding and printing of a new label.

Figure 3:
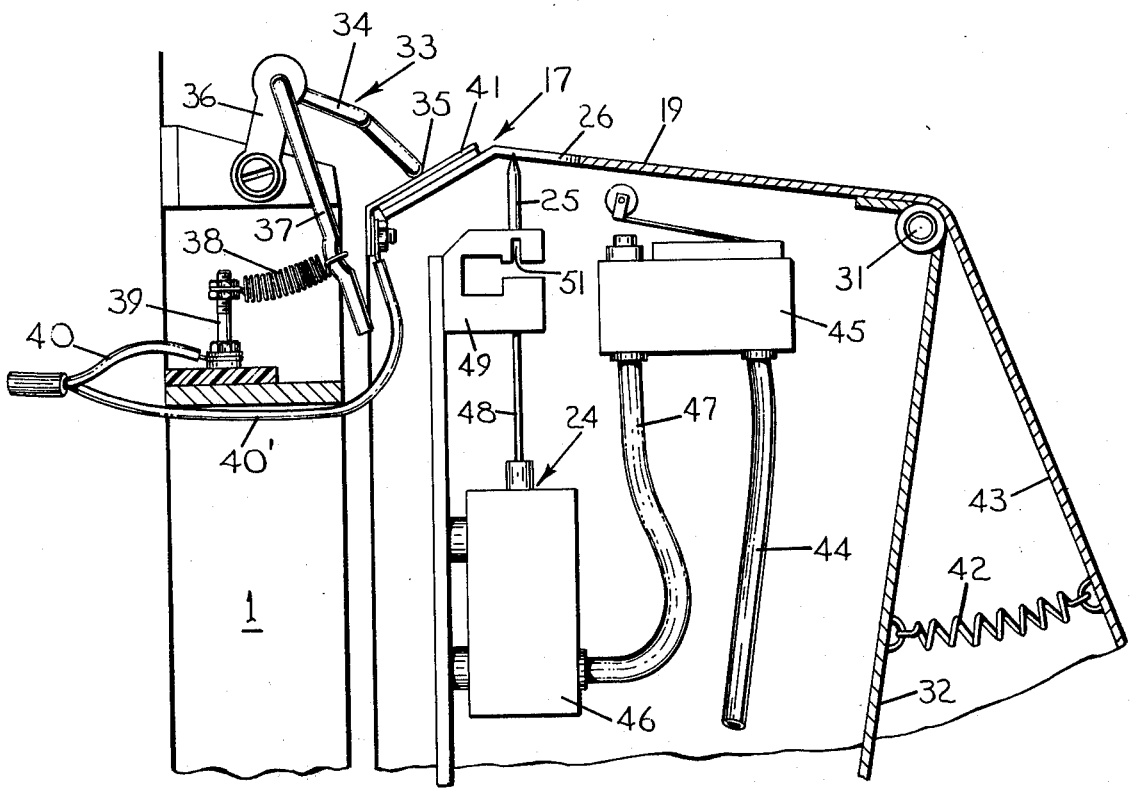
FIG. 3 is a view in side elevation of a portion of the labelling machine shown in greater detail of the modified fixing station in FIG. 2.

With reference to FIGS. 2 and 3 a modification of the fixing station 17 shows the swing plate 19 hinged on a pivot 31 located on the upper end of a plate 32 which is by any suitable means fixed to the frame 1 and in such a position relative to the grooved needle 25 to cause said swing plate 19 to move in an anticlockwise direction when pressed downwardly. The swing plate 19 in addition to effecting the actuation of the electric drive motor 2 and the driving piston 24 is operatively associated with a detector means 33 which is adapted to detect the presence or absence of a label in the fixing station 17.

This detector means 33 (FIGS. 3 and 4) includes a first sensing element 34 that is connected to switch 21 by means of an electrical lead 40 and is pivotally carried by a pair of spaced support members 36 which are fabricated from any suitable non-conductive material. The first sensing element 34 includes a label contact surface 35 which is continually urged in the direction of the swing plate 19 by means of a coil spring 38. One end of spring 38 is attached to a lever 37, that forms an integral part of the first sensing element 34, and the opposite end is attached to a fixed pin 39 that forms the electrical connection between said first sensing element and the electrical lead 40.

The detector means 33 includes a second sensing element in the form of a plate 41 that is connected to switch 21 by means of an electrical lead 40' and is carried on and electrically insulated from the swing plate 19. As shown in FIG. 3, plate 41 is continually urged toward the first sensing element 34 by means of a compression spring 42 which is disposed so that one end engages the lower inner surface 43 of the swing plate 19 and the opposite end an opposed surface on plate 32.

The driving piston 24 is actuated by compressed air received through a feed line 44 which is connected to a valve 45 the latter of which is positioned so as to be actuated by the downward movement of the swing plate 19.

Figure 6:
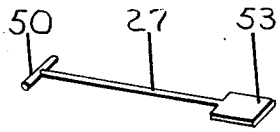
FIG. 6 is a perspective view of the member utilized for attaching a label to a garment.

The driving piston 24 includes a pneumatic cylinder 46 connected by means of an air line 47 to the valve 45. This pneumatic cylinder 46 controls vertical movement of a rod 48, the upper portion of which is slidable within a holder 49 that serves as a source of supply for the plastic retainers 27. As shown in FIG. 6 one end of the plastic retainer 27 is provided with an integrally formed clip element 50 which within the holder 49 is located in a channel 51 formed therein.

Channel 51 is disposed in operative association with the grooved needle 25 and rod 48 so that as the latter is caused to move upwardly it withdraws a plastic retainer 27 from the holder 29 by pushing the clip element 50 upwardly through the groove of said needle, the hole 52 in the label 11 and thence through the fabric of the garment to be labelled.

The end of the plastic retainer 27 opposite that of clip element 50 is provided with an integrally formed enlarged portion 53 which in combination with said clip element 50 serves to prevent a label from becoming detached from a garment.

The control circuit of the labelling machine (FIG. 5) includes a main switch 54 located in a three-phase line 55 for controlling the supply of power to the drive motor 2. One side of a transformer 56 is connected to line 55 and serves to supply power of reduced voltage to a low voltage circuit line 59 that is connected to the opposite side of said transformer.

A relay switch 57 is provided in the line 55 and includes an exciting coil 58 interconnected with the low voltage circuit line 59.

Figure 4:
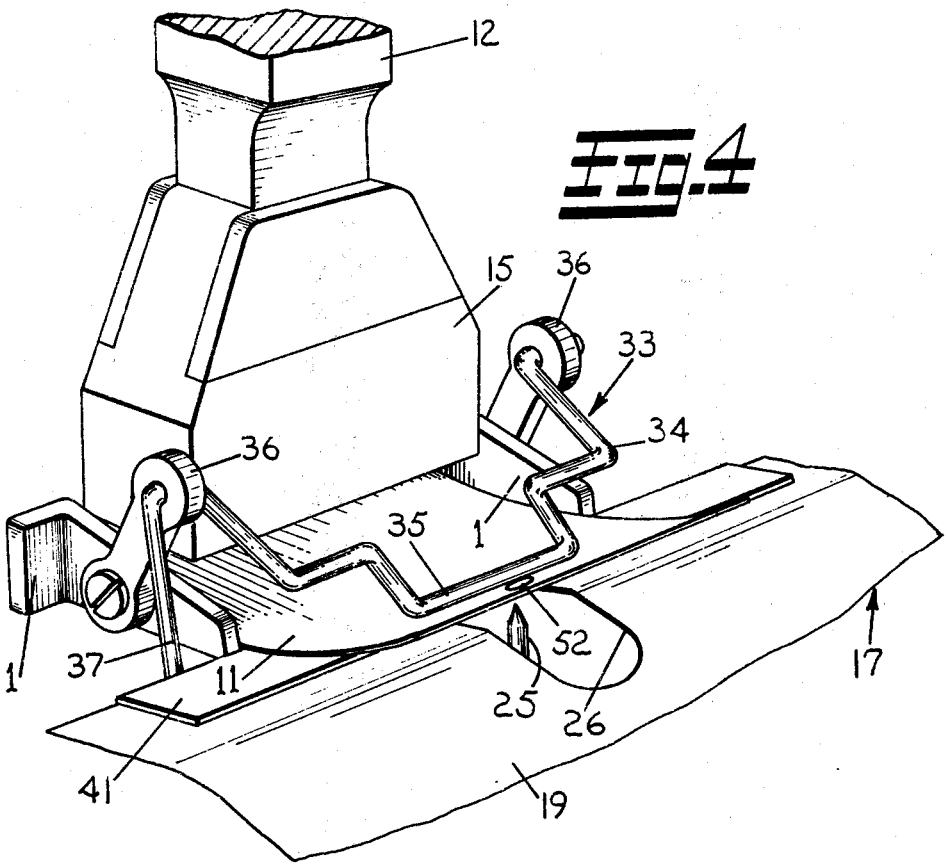
FIG. 4 is a perspective view of a portion of the fixing station in FIG. 3.
Figure 5:
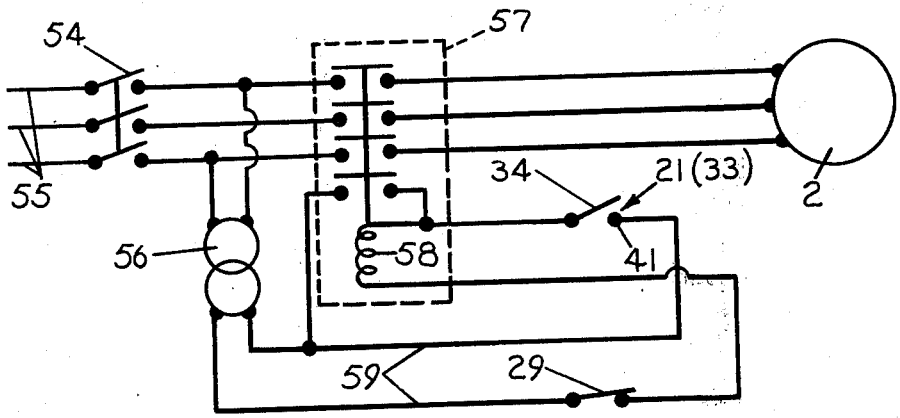
FIG. 5 is a diagrammatic view of the electrical circuit employed.

With the closure of the main switch 54 shown in FIG. 5, the electric drive motor 2 will not operate, because the sensing elements 34 and 41 of the detector 33 are open. As shown in FIG. 4, the sensing element 34 is prevented from making contact with plate 41 by the presence of a label 11 therebetween.

To summarize the operation, an operator places a garment onto the swing plate and presses the same downwardly to effect the attachment of a label 11 to said garment by means of a plastic retainer 27. The labeled garment is then removed and the absence of a label between the sensing element 34 and plate 41 causes said element 34 to engage said plate 41 which completes the circuit to energize coil 58. With the energizing of coil 58, the relay switch 57 is closed to effect delivery of power to the drive motor 2 which then actuates the means for printing and feeding a new label to the fixing station 17.

The drive motor 2 continues to run until the driven end of crank arm 4 engages the actuator 30 of the switch 29 and momentarily closes the contacts thereof. The momentary actuation of switch 29 is sufficient to deenergize coil 58 thus opening the relay switch 57 to discontinue the supply of power to the drive motor 2. Power to the drive motor 2 remains off until the repeat of the cycle of removing the next labelled garment from the swing plate 19.

In the description of both types of fixing stations 17 a single type of plastic retainer and means for applying the same is described; however, it should be understood that other means can be utilized for attaching a label to a garment such as a conventional sewing machine or even a known form of apparatus for attaching a label to a garment by means of clamps, pins, or staples or the like.

When feeding pre-printed labels 11 to the fixing station 17 the buffer element 15 and block 16 can be either removed or deactivated.

We claim:

1. A labelling machine for garments having a container for labels and a fixing station at which the labels are attached to the garments, said labelling machine comprising:

a. means for separately withdrawing labels from the container and presenting them to the fixing station;

b. a drive motor carried by the machine with a first switch means in circuit therewith for activating said withdrawing and presenting means;

c. a second switch means operatively associated with said drive motor which includes;

i. a micro-switch disposed for actuation by said withdrawing and presenting means;

ii. a coil member in circuit with said micro-switch; and iii. a relay switch connected to said coil member for interrupting power to said drive motor upon energizing said coil by said micro-switch during attachment of a label at the fixing station, said fixing station including:

A. a swing plate pivotally carried on the machine defining a supporting plane for the garment and label to be fixed thereon;

B. a stationary fixing device for attaching a label to a garment operatively associated with said swing plate;

C. means disposed for engagement by said swing plate for actuating said fixing device; and D. detector means interconnecting said swing plate with said second switch means for preventing actuation of said withdrawing and presenting means when a label is in the fixing station and with said first switch means for automatically actuating the same upon removal of the labelling garment from the fixing station.

2. The labelling machine according to claim 1 wherein said detector means includes first and second sensing elements with biasing means for continuously urging said sensing elements one toward the other for detecting the presence or absence of a label therebetween.

3. The labelling machine according to claim 2 wherein said first sensing element is pivotally supported above said swing plate and said second element is fixed on said swing plate in a position to engage said first sensing element in the absence of a label therebetween and initiate actuation of said first switch means.

* * * * *